United States Patent [19]

Takegawa

[11] Patent Number: 4,462,434

[45] Date of Patent: Jul. 31, 1984

[54] WEFT RESERVOIR FOR FLUID-JET LOOMS

[75] Inventor: Yujiro Takegawa, Ishikawa, Japan

[73] Assignee: Tsudakoma Kogyo Kabushiki Kaisha, Japan

[21] Appl. No.: 355,119

[22] Filed: Mar. 5, 1982

[30] Foreign Application Priority Data

Mar. 6, 1981 [JP] Japan ..... 56-033001

[51] Int. Cl.[3] ..... D03D 47/36

[52] U.S. Cl. ..... 139/452; 242/47.01

[58] Field of Search ..... 139/452; 66/132 R; 242/47.01, 47.12

[56] References Cited

U.S. PATENT DOCUMENTS 3,243,975 4/1966 Lawson et al. ..... 242/47.01
4,132,370 1/1979 Mullekom ..... 242/47.12
4,238,080 12/1980 Mullekom ..... 242/47.01
4,239,066 12/1980 Takahashi ..... 242/47.01
4,278,112 7/1981 Takahashi ..... 139/452

*Primary Examiner*—Henry Jaudon
*Attorney, Agent, or Firm*—Lerner, David, Littenberg, Krumholz & Mentlik

[57] ABSTRACT

On a weft reservoir for fluid jet-type looms on which winds of weft are formed on a stationary weft reserving section by rotation of a yarn guide around the weft reserving section, and are transferred in the weft delivery direction by operation of a weft transfer mechanism, the diameter of the weft reserving section is concentrically adjusted and the relative position of the weft transfer mechanism with respect to the surface of the weft reserving section and its operational timings are kept unchanged even after the diameter adjustment for formation of stable and constant balooning of the weft to be delivered under any picking condition.

5 Claims, 4 Drawing Figures

WEFT RESERVOIR FOR FLUID-JET LOOMS

BACKGROUND OF THE INVENTION

The present invention relates to a weft reservoir for fluid-jet looms, and more particularly relates to improvement in construction of a weft reservoir on which weft is wound for reservation about a stationary drum-type weft reserving section by operation of a yarn guide rotating around the weft reserving section.

On a weft reservoir of this type in general, the length of weft for one pick is reserved on the weft reserving section in the form of a number of continuous windings at prescribed intervals and the reserved weft is sequentially transferred in the axial direction of the weft reserving section, i.e. the delivery direction of weft.

The length of weft for one pick varies depending on the width of the cloth to be woven. In order to change the length of weft for one pick, the amount of weft to be wound on the weft reserving section has to be changed. To this end, it is theoretically thinkable to change the number of windings on the drum-type weft reservoir. In practice, however, change in number of windings often makes it infeasible to obtain a correct length of weft for one pick. In order to avoid this inconvenience, it is also thinkable, in combination with change in number of windings, to change the diameter of the weft reserving section in order to assure a correct length of weft for one pick.

For example, the weft reservoir disclosed in the Japanese Patent Opening No. 55-2595 based on the Dutch Application No. 7806469 suffices this requirement to an appreciable extent. In the case of this previous weft reservoir, its weft reserving section is comprised of two different parts combined in an axial alignment, i.e. the first part fixed to the drive shaft and a fixed diameter and the second part having adjustable in diameter. A yarn guide is driven for rotation around the weft reserving section for weft reservation. The first part is accompanied with a weft transfer mechanism which sequentially transfers winds of weft on the first part in the axial delivery direction. By adjusting the diameter of the second section, the peripheral length of the weft reserving section can be varied as desired in order to obtain a correct length of weft for one pick in accordance with the width of the cloth to be woven.

This previous weft reservoir, however, is still accompanied with an operational trouble caused by the manner of change in diameter of the second section. The weft is delivered from the weft reservoir by fluid ejection of the main nozzle after the weft transfer mechanism has disappeared under the peripheral surface of the first section. Since the peripheral surface of the weft reserving section is in general rendered very smooth in order to minimize resistance against weft delivery. This low resistance, however, makes the unwinding of weft from the first part quicker than the delivery speed by the main nozzle thereby causing extremely large ballooning of the weft under delivery.

As described already, the weft winding section now in question is made of the first and second parts both coupled to the common drive shaft. In order to adjust the amount of weft to be wound on the weft reserving section, the diameter of the second section only is changed. Since the change in diameter is performed in an eccentric fashion, the second part assumes an oblong transverse cross sectional profile after this change in diameter which inevitably causes difference in distance between peripheral points on the weft reserving section and a main nozzle side yarn guide eye. This produces a gap between the axis of weft baloon and the axis of the main nozzle side yarn guide eye.

This gap and the above-described low resistance against weft delivery further unstable weft balooning. Such unstable weft balooning naturally causes undesirable fluctuation of weft delivery tension and tends to eventuate in unstable weft picking.

SUMMARY OF THE INVENTION

It is the object of the present invention to provide a weft reservoir on which the diameter of the weft reserving section can be freely adjusted without causing any unstable weft picking.

In accordance with the basic aspect of the present invention, the diameter of the weft reserving section is concentrically changed and the position and operation of a weft transfer mechanism relative to the weft reserving section are kept unchanged despite the change in diameter of the weft reserving section.

DESCRIPTION OF THE PREFERRED EMBODIMENTS

Figure 1:
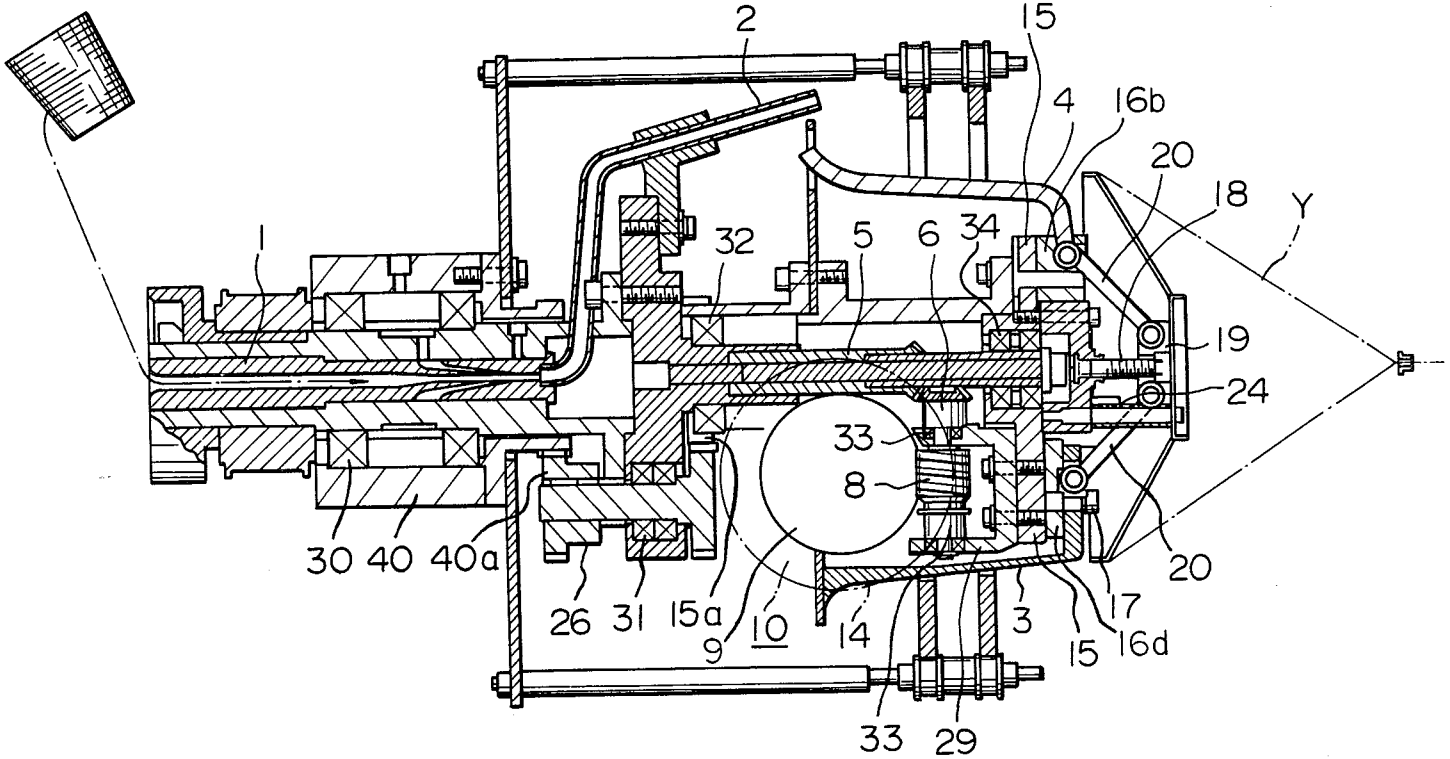
FIG. 1 is a sectional side view of one embodiment of the weft reservoir in accordance with the present invention, some elements being omitted and simplified for better understanding of the general construction.

A typical embodiment of the weft reservoir in accordance with the present invention is illustrated in FIG. 1, in which the weft reservoir includes a drive shaft 1 mounted to a drum bracket 40 fixed to the loom framework (not shown) by means of a bearing 30. The drive shaft 1 carries a yarn guide 2 for rotation around a stationary weft winding section which is made up of a winding drum 3 and a plurality of radial rods 4, i.e. radial rods 4*a* to 4*f*, arranged side by side at equal angular intervals along the periphery of the winding drum 3. The yarn guide 2 extends forwards, i.e. in the axial weft delivery direction, whereas the radial rods 4*a* to 4*f* extend in an arrangement not to disturb the rotation of the yarn guide 2.

An elongated base bracket 15 is coupled to the drive shaft 1 by means of bearings 32 and 34. A gear 15*a* is formed on the rear end of the base bracket 15 in meshing engagement with one end a gear 26 carried by bearings 31 whereas the other end of the gear 26 is in meshing engagement with a gear 40*a* formed on the drum bracket 40. Due to this construction, the base bracket 15 remains standstill even when the drive shaft 1 rotates.

Figure 2:
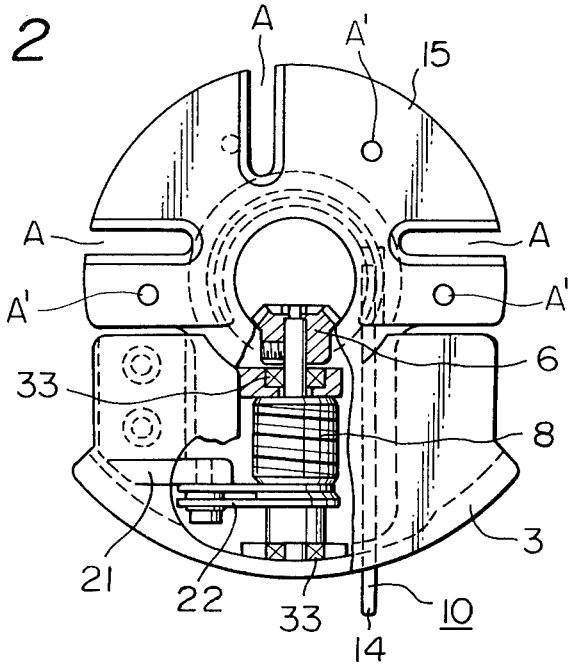
FIG. 2 is an end view, partly in section, a part of the weft reservoir shown in FIG. 1 seen from the side of the main nozzle.

A number of rod bases 16, i.e. rod bases 16*a* to 16*c*, and a drum support 16*d* are attached to the front face of the base bracket 15. As best seen in FIG. 2, slots A are formed in the front face of the base bracket 15 which extends inwards from the periphery. Each slot A is accompanied with one or more threaded holes A'. Each rod base 16 is coupled to the base bracket 15 by means of a set screw 17' received in the threaded hole A'. One more screw 17 is screwed into each rod base 16 and received in the associated slot A in the base bracket 15. The radial rods 4 are coupled at their front ends to the associated rod bases 16. Likewise, two set screws 17' are used in engagement with the threaded holes A' for coupling the drum support **16*d* to the base bracket 15 and two screws 17 are received in the associated slot A. The winding drum 3 is coupled at its front end to the drum support 16*d*. As later described in more detail, a number of jack rods 20 are coupled to the radial rods 4 and the winding drum 3** by means of universal joints.

Figure 4:
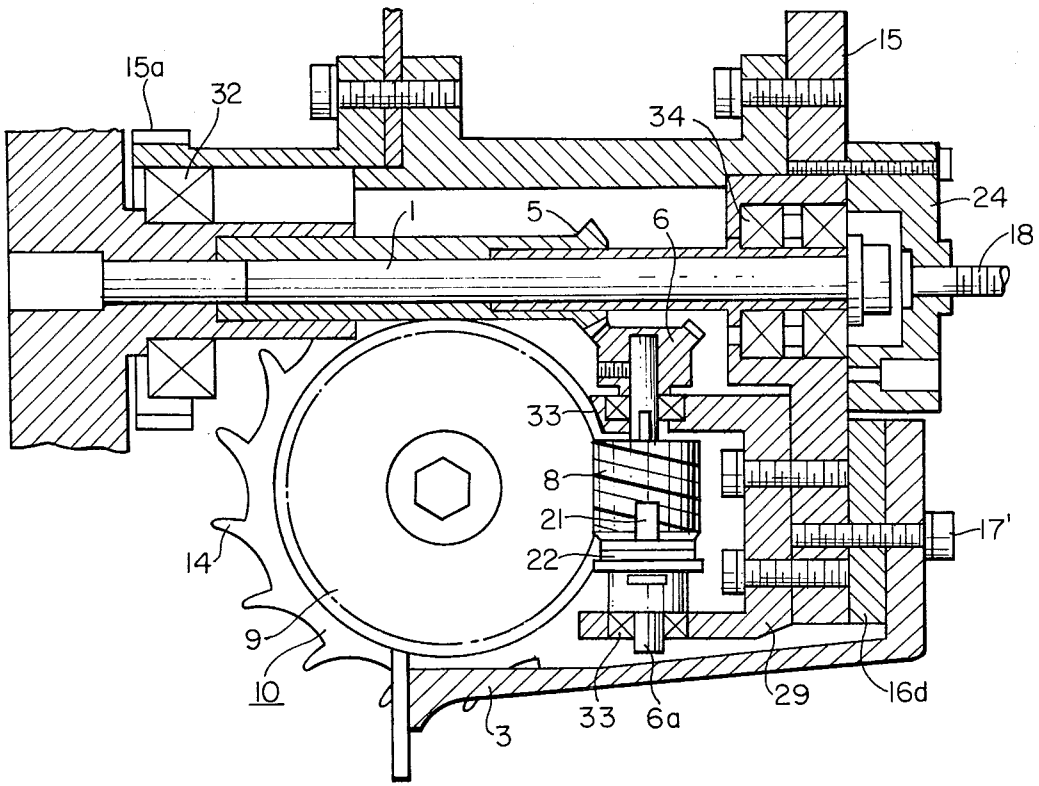
FIG. 4 is an enlarged side view, partly in section of a weft transfer mechanism used for the weft reservoir shown in FIG. 1.

As best seen in FIG. 4, a bracket 29 having a pair of axially aligned bearings 33 is fixed to the front end of the base bracket 15 on the side opposite to the mounting of the rod bases 16. The bearings 33 rotatably carries, by means of a shaft **6*a*, a driven bevel gear 6 in meshing engagement with a drive bevel gear 5 fixedly inserted over the drive shaft 1. The shaft 6*a* for the driven bevel gear 6 further carries a worm gear 8 by means of spline engagement so that the worm gear 8 is shiftable in the direction of the spline. As shown in FIG. 2, the worm gear 8 is supported by a shifter 22 which is fixed to the winding drum 3 via a shifter bracket 21. A worm wheel 9 is rotatably mounted to the inside wall of the winding drum 3 in meshing engagement with the worm gear 8 on the shaft 6*a*. A stopper 10 is coaxially mounted to the worm wheel 9 by means of a stopper seat 39 and provided with weft transfer pawls 14** for transferring the weft wound about the weft reserving section in the axial weft deliviery direction.

As the drive shaft 1 performs one complete rotation and the yarn guide 2 forms one winding on the weft reserving section, the rotation of the drive shaft 1 is transmitted to the worm gear 8 via the bevel gears 5 and 6 and the shaft **6*a*. Then the stopper 10 is driven for rotation via the worm wheel 9 to which the stopper 10 is mounted. Thereupon the transfer pawls 14 project sequentially on the surface of the winding drum 3 and moves in the axial weft delivery direction in order to transfer the winding of weft between adjacent transfer pawls 14** on the winding drum in the same direction.

Figure 3:
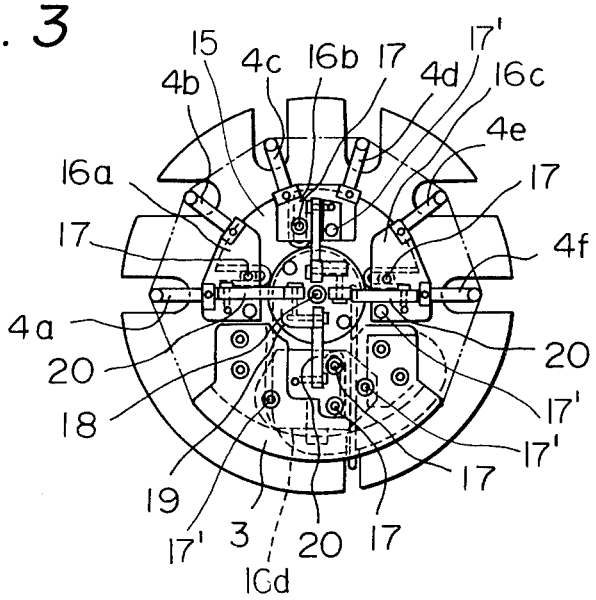
FIG. 3 is an end view, partly in section, of the weft reservoir shown in FIG. 1 seen from the side of the main nozzle.

As best seen in FIG. 3, one ends of the first and second radial rods **4*a* and 4*b* are coupled to in the first rod base 16*a*, one ends of the third and fourth radial rods 4*a* and 4*d* are coupled to in the second rod base 16*b*, and one ends of the fifth and sixth radial rods 4*e* and 4*f* are coupled to in the third rod base 16*c*, respectively. The ends of the jack rods 20 are rotatably coupled to the rod bases 16 and to the winding drum 3 whereas the other ends of the jack rods 20 are rotatably coupled to a later described jack hinge 19**.

A jack base 24 is fixed to the weft delivery side face of the base bracket 15 in a coaxial alignment, and provided with an axial through hole in which a jack bolt 18 is idly received. An outer flange is formed at the rear end of the jack bolt 18 in order to block falling-out of the jack bolt 18 from the through hole in the base bracket 15. Here, the rear end of the jack bolt 18 is located out of contact with the front end of the drive shaft 1. The front end section of this jack bolt 18 is placed in screw engagement with the above-described jack hinge 19. The distal end of the jack bolt 18 is provided with a configuration suited for manual turning by a screw driver or a like tool.

In order to adjust the diameter of the weft reserving section on the weft reservoir of the above-described construction, the set screws 17' for the rod bases 16 and the winding drum 3 are loosed and the jack bolt 18 is manually turned. Since the jack bolt 18 is held in screw engagement with the jack hinge 19, turning of the jack bolt 18 urges the jack hinge 19 to move along the jack bolt 18.

As the jack hinge 19 moves in the longitudinal direction of the jack bolt 18, the ends of the jack rods 20 on the side of the rod bases 16 and the drum support **16*d* move away from or towards the axis of the weft reservoir. Then the rod bases 16 and the drum support 16*d* move in the direction of the radial slots A formed in the base bracket 15 outwards or inwards with respect to the axis of the weft reservoir over a distance equal to that of the movement of the jack rods 20. During the movement, the screws 17 held by the rod bases 16 and the drum support 16*d* slide along the associated slots A. Then the diameter of the weft winding section, which is formed by the radial rods 4 and the winding drum 3**, can be concentrically adjusted.

After the diameter adjustment is completed, the set screws 17' are manually fastened in order to again fix the rod bases 16 and the drum support **16*d* to the base bracket 15**.

Now it is assumed that the diameter of the weft reserving section has been increased. Complete disappearance of the transfer pawls 14 of the stopper 10 from the surface of the weft reserving section would disenable smooth weft transfer in the axial weft delivery direction. Further, even when the diameter adjustment is effected to an extent such that the transfer pawls 14 of the stopper 10 should not disappear from the surface of the weft reserving section, at least the timing of disappearance would change. This change in timing of disappearance causes fluctuation in slacking condition of the weft wound about the weft reserving section whilst eventuating in undesirable fluctuation in resistance against weft delivery. This means that the condition of weft picking has to be carefully checked every time the diameter adjustement is effected.

In order to avoid this inconvenience, the relative position of the transfer pawls 14 and the surface of the weft reserving section has to be kept unchanged even after the diameter adjustment. In order to suffice this requirement, the shaft **6*a* for the worm gear 8 is directed radially to the drive shaft 1 so that its longitudinal direction should meet the shifting direction of the winding drum 3 during the diamter adjustment, in accordance with the present invention. The worm gear 8 is arranged movable along the shaft 6*a* due to the spline engagement when driven by the shifter 22 on the shifter bracket 21, which is fixed to the winding drum 3**.

As described already, the worm wheel 9 held in meshing engagement with the worm gear 8 is rotatably to the winding drum 3 by means of an appropriate bracket (not shown) and carries a stopper 10 having the transfer pawls 14. As the winding drum 3 shifts in the radial direction of the weft reservoir for diameter adjustment, the worm wheel 9 coupled to the winding drum 3 moves in the same direction over the same distance together with the stopper 10 having the transfer pawls 14. As a consequence, the relative position of the transfer pawls 14 with respect to the surface of the weft reserving section, i.e. the winding drum 3, remains unchanged even after the diameter adjustment.

Further, since the worm wheel 9 and the worm gear 8 are both mounted to the winding drum 3 and move in the same direction over a same distance, their meshing engagement is maintained even after the diameter adjustment of the weft reserving section so that rotation speed of the stopper 10 should not be changed and the transfer pawls 14 should appear on and disappear from the surface of the weft reserving section at unchanged timings.

As is clear from the foregoing description, adjustment of the amount of weft to be reserved is effected in accordance with the present invention by concentrically changing the diameter of the weft reserving section on the weft reservoir. Unchanged relative position of the weft transfer pawls with respect to the surface of the weft reserving section and its unchanged operational timings assure stable delivery of the weft from the weft reservoir. Even after the above-described diameter adjustment, the axis of weft balooning is kept in line with that of the main nozzle yarn guide eye, whereby weft baloons always assume a normal form without any fluctuation in weft delivery tension.

The relative position between the worm wheel 9 and the worn gear 8 is kept unchanged even after the diameter adjustment so that the rotation speed of the stopper 10 mounted to the worm wheel 9 should not change. As a consequence, the operational timings of the transfer pawls 14 on the stopper 10 remain unchanged, thereby successfully avoiding the trouble of checking the operational timings when the diameter is adjusted.

There is a certain limit to the extent of diameter adjustment in accordance with the present invention. When any diameter adjustment beyond such a limit is required, the number of wind of weft for one pick has to be changed. In this case, it is necessary to change the transmission ratio of rotation between the drive shaft 1 and the stopper 10. This can easily be effected by replacing the drive and driven gears 5 and 6 without any influence on the operational timings of the transfer pawls 14.

I claim:

1. A weft reservoir for fluid-jet looms comprising a rotary drive shaft extending in the axial direction of said weft reservoir, an axially elongated, stationary base bracket mounted to said drive shaft by means of bearings, a weft reserving section coupled to said base bracket whilst spacedly and concentrically embracing said drive shaft.

a yarn guide mounted to said drive shaft in an arrangement rotatable around said weft reserving section for formation of windings of weft to be reserved, a weft transfer mechanism coupled internally to said weft reserving section and driven for rotation by said drive shaft for transfer of said windings of weft on said weft reserving section in the axial weft delivery direction, means coupled to said base bracket and for concentrically adjusting the diameter of said weft reserving section when manually operated, and means coupled to said base bracket and for maintaining the relative position of said weft transfer mechanism with respect to said weft reserving section unchanged despite adjustment in diameter of said weft reserving section.

2. A weft reservoir as claimed in claim 1 in which said weft reserving section includes a plurality of rod bases and a drum support arranged along the periphery of the weft delivery side face of said base bracket in an arrangement movable in the direction of associated slots formed in said base bracket substantially radially with respect to said drive shaft, a plurality of radial rods each coupled to one of said rod bases and extending opposite to said weft delivery side, and a winding drum coupled to said drum support and extending opposite to said weft delivery side.

3. A weft reservoir as claimed in claim 2 in which said weft transfer mechanism includes a circular stopper rotatably mounted in said winding drum and having a plurality of circumferential transfer pawls and means for operationally coupling said stopper to said drive shaft for concurrent rotation so that said transfer pawls should sequentially appear on said weft reserving section for transfer of said windings of weft on said weft reserving section in said weft delivery direction.

4. A weft reservoir as claimed in claim 3 in which said adjusting means includes a jack base coupled to said weft delivery side face of said base bracket and having an axial through hole in alignment with said drive shaft, a jack bolt rotatably received at its rear end in said axial through hole in said jack base, a jack hinge fully screwed over said jack bolt in an arrangement such that said jack hinge should be driven for movement along said jack bolt in the axial direction of said weft reservoir when said jack bolt is axially turned, and a plurality of jack rods coupled at one ends to said rod bases and said drum support via universal joints and at the other ends to said jack hinge via universal joints.

5. A weft reservoir as claimed in claim 3 in which said maintaining means includes a drive gear fixedly inserted over said drive shaft, a support shaft rotatably mounted in said winding drum and extending in the radial direction of said weft reserving section, a driven gear fixedly mounted to said support shaft in meshing engagement with said drive gear, a worm gear mounted to said support shaft in an arrangement movable in the longitudinal direction of said support shaft, and a worm wheel rotatably mounted in said winding drum in meshing engagement with said worm gear and coaxially holding said stopper.

* * * * *

UNITED STATES PATENT AND TRADEMARK OFFICE

CERTIFICATE OF CORRECTION

PATENT NO. : 4,462,434

DATED : July 31, 1984

INVENTOR(S) : Takegawa

It is certified that error appears in the above-identified patent and that said Letters Patent are hereby corrected as shown below:

Column 1, line 36, after the word "and" insert -- having --.
Column 1, line 37, cancel the word "having".
Column 2, line 53, after the word "extend" insert -- rearwards --.
Column 3, line 32, "deliviery" should read -- delivery --.
Column 3, line 45, cancel "in".
Column 3, line 47, cancel "in".
Column 3, line 49, cancel "in".
Column 3, line 64, cancel the word "distal" and substitute therefore -- front --.
Column 4, line 54, after the word "rotatably" insert -- mounted --.

Signed and Sealed this

*Twenty-ninth* Day of *January 1985*

[SEAL]

*Attest:*

DONALD J. QUIGG

*Attesting Officer* *Acting Commissioner of Patents and Trademarks*